US007009096B2

(12) United States Patent
Hirayama

(10) Patent No.: US 7,009,096 B2
(45) Date of Patent: Mar. 7, 2006

(54) TREMOLO UNIT AND ELECTRIC GUITAR HAVING THE SAME

(75) Inventor: Shinjiro Hirayama, Seto (JP)

(73) Assignee: Hoshino Gakki Co., Ltd. (JP)

( * ) Notice: Subject to any disclaimer, the term of this patent is extended or adjusted under 35 U.S.C. 154(b) by 146 days.

(21) Appl. No.: 10/756,786

(22) Filed: Jan. 12, 2004

(65) Prior Publication Data

US 2004/0177741 A1 Sep. 16, 2004

(30) Foreign Application Priority Data

Feb. 27, 2003 (JP) ..... 2003-051663

(51) Int. Cl.
*G10D 3/00* (2006.01)

(52) U.S. Cl. ..... 84/313; 84/312 R

(58) Field of Classification Search ..... 84/312, 84/313, 318, 317, 298, 299, 307, 300–302
See application file for complete search history.

(56) References Cited

U.S. PATENT DOCUMENTS 5,880,383 A * 3/1999 Huff ..... 84/313
6,710,235 B1 * 3/2004 Hirayama ..... 84/313
6,797,870 B1 * 9/2004 Kang ..... 84/313

FOREIGN PATENT DOCUMENTS

JP 2003-005751 1/2003

* cited by examiner

*Primary Examiner*—Kimberly Lockett
(74) *Attorney, Agent, or Firm*—Ostrolenk, Faber, Gerb & Soffen, LLP

(57) ABSTRACT

A tremolo operating mechanism comprising an arm socket secured onto a base plate, a resin bushing contained in the upper part of the arm socket, a torque adjusting screw screwed into the upper part of the arm socket to press the resin bushing, and an arm receiving resin nut which is engaged with the lower part of the arm socket and is also engaged with the lower end portion of a tremolo arm. The tremolo arm rotates on the shaft thereof to change the amount of screw engagement with the arm receiving resin nut and adjust the height of the tremolo arm from the body. As the torque adjusting screw rotates, the torque of the tremolo arm is adjusted by the resin bushing. Since the tremolo arm is supported by the resin bushing and the arm receiving resin nut, it does not interfere with the arm socket to improve operability.

14 Claims, 6 Drawing Sheets

Fig 7(a)
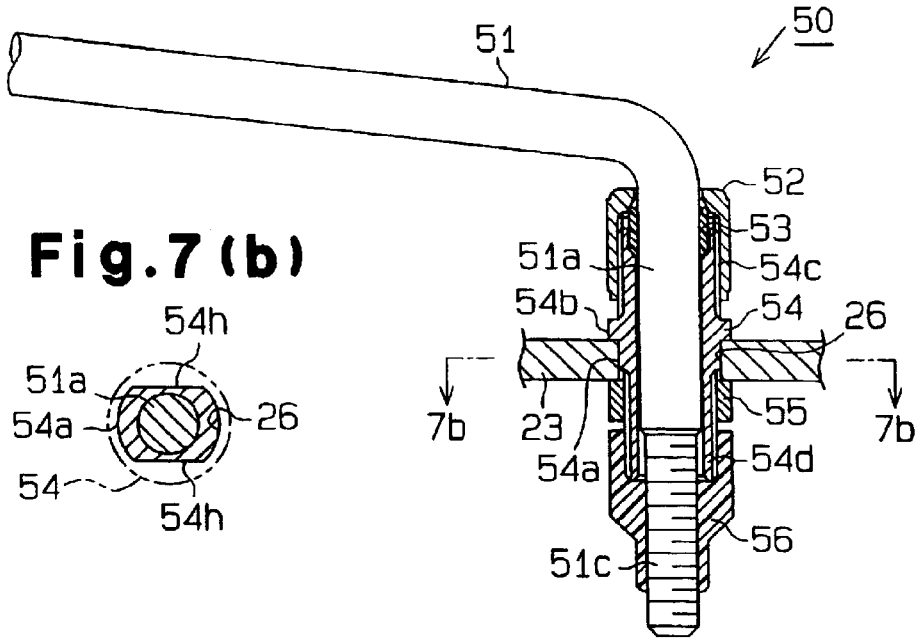
Fig.7(b)
Fig.8(a)
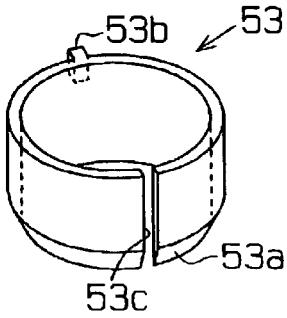
Fig.8(c)
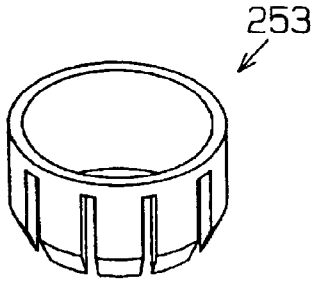
Fig.8(b)
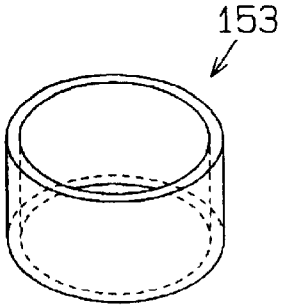
Fig.8(d)
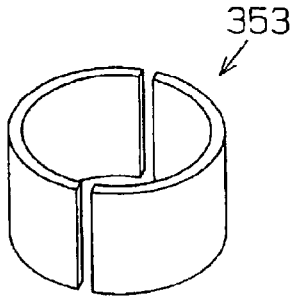

TREMOLO UNIT AND ELECTRIC GUITAR HAVING THE SAME

BACKGROUND OF THE INVENTION

The present invention relates to a tremolo unit and an electric guitar having the tremolo unit. More specifically, the present invention relates to a tremolo unit having a tremolo arm, which tremolo arm has excellent operability and facilitates height adjustment and torque adjustment. The present invention also relates to an electric guitar having the tremolo unit.

In some conventional tremolo units, a metallic cylindrical member is fixed to a swingable base plate, and a tremolo arm is inserted at the proximal end portion to the cylindrical member. In this type of tremolo unit, the tremolo arm is rotatable, so that a player can rotate the grip of the tremolo arm to a position where the tremolo arm opposes the strings of an electric guitar to change the tension of the strings during playing of the guitar. Meanwhile, when the tremolo unit is not used, the grip of the tremolo arm turns downward by its own weight, so that the grip can be cleared away to a position where it does not interfere with playing of the guitar.

However, in this arrangement, since the tremolo arm is merely inserted into the cylindrical member, it is impossible to adjust the height of the tremolo arm relative to the body of the guitar and to keep the grip of the tremolo arm at a position where the tremolo arm opposes the strings. Further, the tremolo arm comes off the guitar in some cases.

Under such circumstances, a tremolo unit is disclosed in Japanese Laid-open Patent Publication No. 2003-005751, in which a tremolo arm is threaded at the proximal end portion, which is screwed into a cylindrical member provided on a base plate to enable height adjustment of the tremolo arm. There is another type of tremolo unit, in which a tremolo arm is pressed at the proximal end portion with a spring or the like to apply frictional resistance to rotation of the tremolo arm.

However, in the threaded tremolo arm described above, although the height of the tremolo arm can be adjusted using the thread, the use of the metallic cylindrical member requires a predetermined clearance between the tremolo arm and the cylindrical member so that the tremolo arm is rotatable. In addition, when the tremolo arm is operated, a great force is applied to its proximal end portion. This makes it impossible to perform adjustment of torque when the tremolo arm is rotated. Besides, the clearance induces interference between metallic parts due to backlash when the tremolo arm is operated and causes impacts and noise, which disadvantageously lower the operability of the tremolo arm. In the case of a tremolo arm that is pressed at the proximal end portion with a spring or the like, although the tremolo arm can be rotated to a desired position and can be held there under friction between the tremolo arm and the cylindrical member, interference between metallic parts attributed to backlash occurs when the tremolo arm is operated to cause impacts and noise, which disadvantageously lower the operability of the tremolo arm.

SUMMARY OF THE INVENTION

In order to solve the problems described above, the present invention is directed to providing a tremolo unit that has excellent operability. Another aspect of the present invention is to provide a tremolo unit that facilitates height adjustment and torque adjustment.

To achieve the foregoing and other objectives, and in accordance with the purpose of the present invention, a tremolo unit for use in an electric guitar having a body, a head, and a plurality of strings is provided. The strings are attached at the distal ends to the head of the electric guitar and at the proximal ends to the tremolo unit. The tremolo unit includes a swinging member, a string holding device, an urging force applying device, a tremolo arm, a holding cylinder, a first supporting member, and a second supporting member. The swinging member is supported swingably on an upper surface of the body. The string holding device is provided on the swinging member to hold each string at the proximal end thereof. The urging force applying device applies an urging force to the swinging member. The urging force countervails the tension of the strings. The tremolo arm has a shaft rotatably fitted to the swinging member and a handle extended from the shaft at an angle. The handle of the tremolo arm is capable of shifting between an active position, where the handle opposes the strings, and a retracted position, where the handle is spaced away from the strings. The swinging member is designed to be swung through the handle to change tension of each string. The holding cylinder is provided on the swinging member to insert the shaft of the tremolo arm therein. The first supporting member is made of an elastic body, and is interposed between the holding cylinder and the shaft so as to avoid contact between them. The second supporting member is made of an elastic body, and is interposed between the holding cylinder and the shaft at a position spaced away from the first supporting member so as to avoid contact between them.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 7(*a*) is a cross-sectional view of the tremolo operating mechanism;

FIG. 7(*b*) is a cross-sectional view taken along the line 7*b*—7*b* in FIG. 7(*a*);

FIG. 8(*a*) is a perspective view of a resin bushing according to an embodiment of the present invention;

FIG. 8(*b*) is a perspective view showing a first modification of the resin bushing;

FIG. 8(*c*) is a perspective view showing a second modification of the resin bushing; and FIG. 8(*d*) is a perspective view showing a third modification of the resin bushing.

DETAILED DESCRIPTION OF THE PREFERRED EMBODIMENTS

An electric guitar 11 provided with a tremolo unit 21 according to an embodiment of the present invention will be described below referring to FIGS. 1 to 8(*a*).

Figure 1:
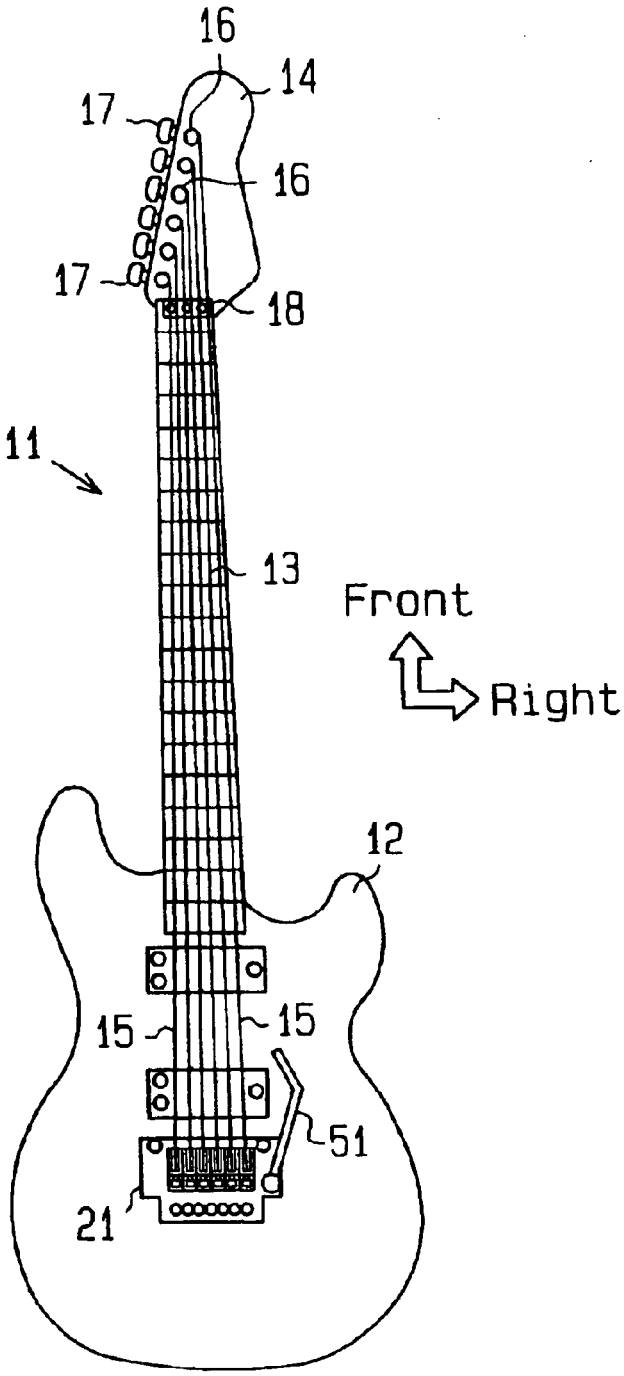
FIG. 1 is a plan view showing an entire electric guitar.
Figure 2:
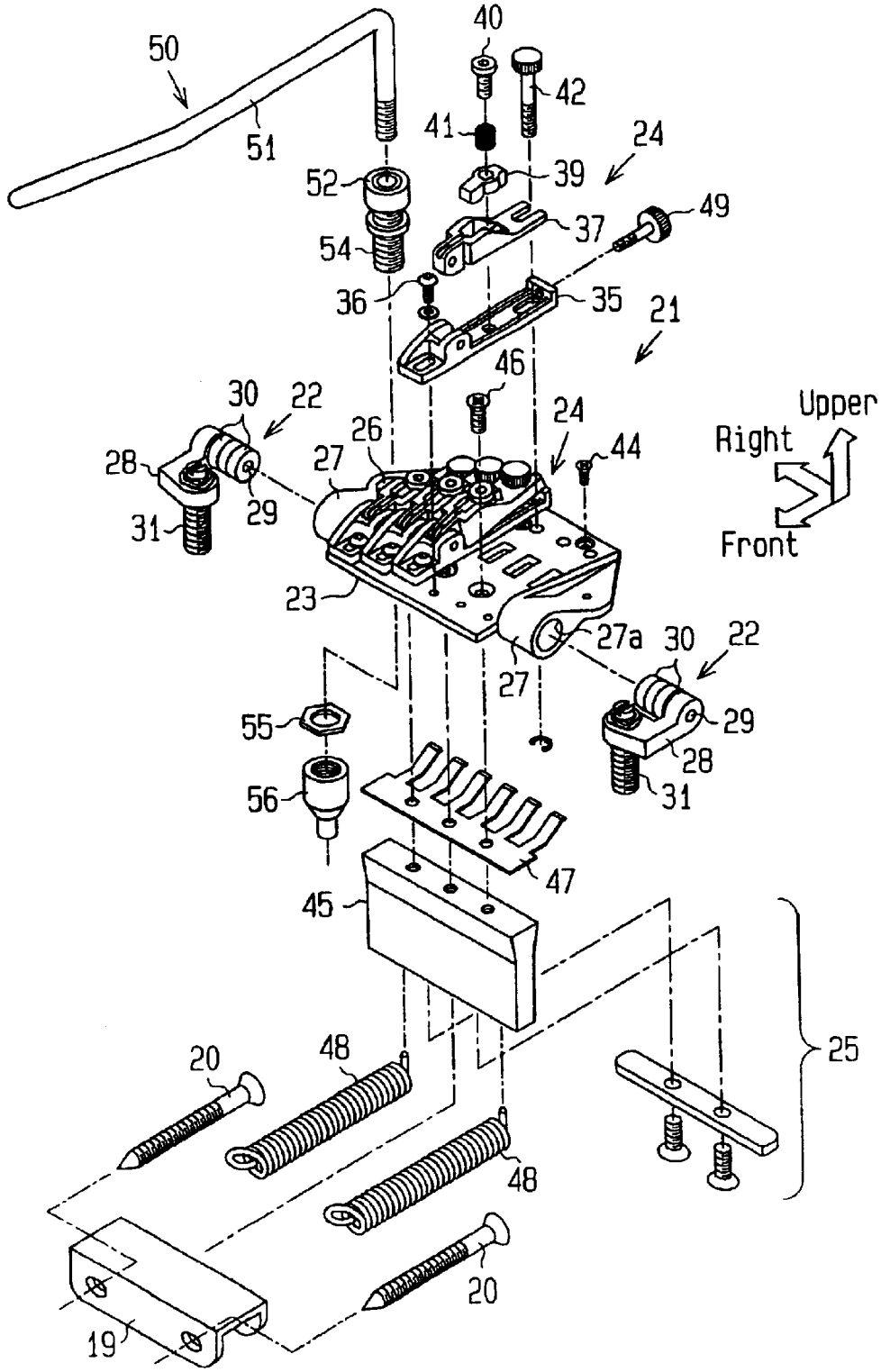
FIG. 2 is an exploded perspective view of the tremolo unit.

For convenience of explanation, a part of the guitar 11 that corresponds to a head 14 and a part corresponding to a tremolo arm 51 of the electric guitar 11 are defined as the front and the right of the guitar 11, respectively, in terms of FIGS. 1 and 2. Further, the direction spaced apart from the body of the electric guitar 11 is defined as an upper direction.

The electric guitar 11 shown in FIG. 1 is provided with a solid type body 12 and a neck 13 extended frontward from the body 12. The head 14 is provided at the front end of the neck 13, and six string poles 16 protrude rotatably therefrom. The string poles 16 wind six strings 15, respectively. Each string pole 16 has on the rear side a turning peg 17 that has a gear mechanism (not shown) and protrudes from the head 14. The string poles 16 are turned by turning the turning pegs 17, respectively. Pitch (tension) of each string 15 is adjusted by the string pole 16, the gear mechanism and the turning peg 17. A nut 18 is provided at the distal end portion of the neck 13, and the strings 15 are brought into critical contact with the nut 18. Further, the strings 15 are held down by a holding member and are fastened through the holding member to the nut 18 with bolts.

The tremolo unit 21 is disposed substantially at the center of the body 12. The tremolo unit 21 is provided with bridge saddles 24, which correspond to the string holding means. The strings 15 are held by the saddles 24 respectively. The six strings 15 are brought into a first critical contact with the nut 18 and into a second critical contact with the tremolo unit 21. The six strings 15 are extended substantially parallel to one another with a predetermined tension between the nut 18 and the tremolo unit 21. The body 12 has a pick-up, which detects vibrations of strings and converts them into electric signals. The electric signals generated by the pick-up are amplified by an external amplifier through a shield cable (not shown) and are converted into sounds.

Next, the tremolo unit 21 will be described referring to FIG. 2. The tremolo unit 21 contains a base plate 23, which is attached swingably to the body 12 by a hinge mechanism 22, and the bridge saddles 24, which are mounted on the upper surface of the base plate 23 and support the strings 15 respectively. The base plate 23 has on the lower side an urging force applying mechanism 25, which applies to the base plate 23 an urging force countervailing the tensions of the strings 15. The base plate 23 also has a tremolo operating mechanism 50, which swings the base plate 23 on the hinge mechanism 22.

Figure 6:
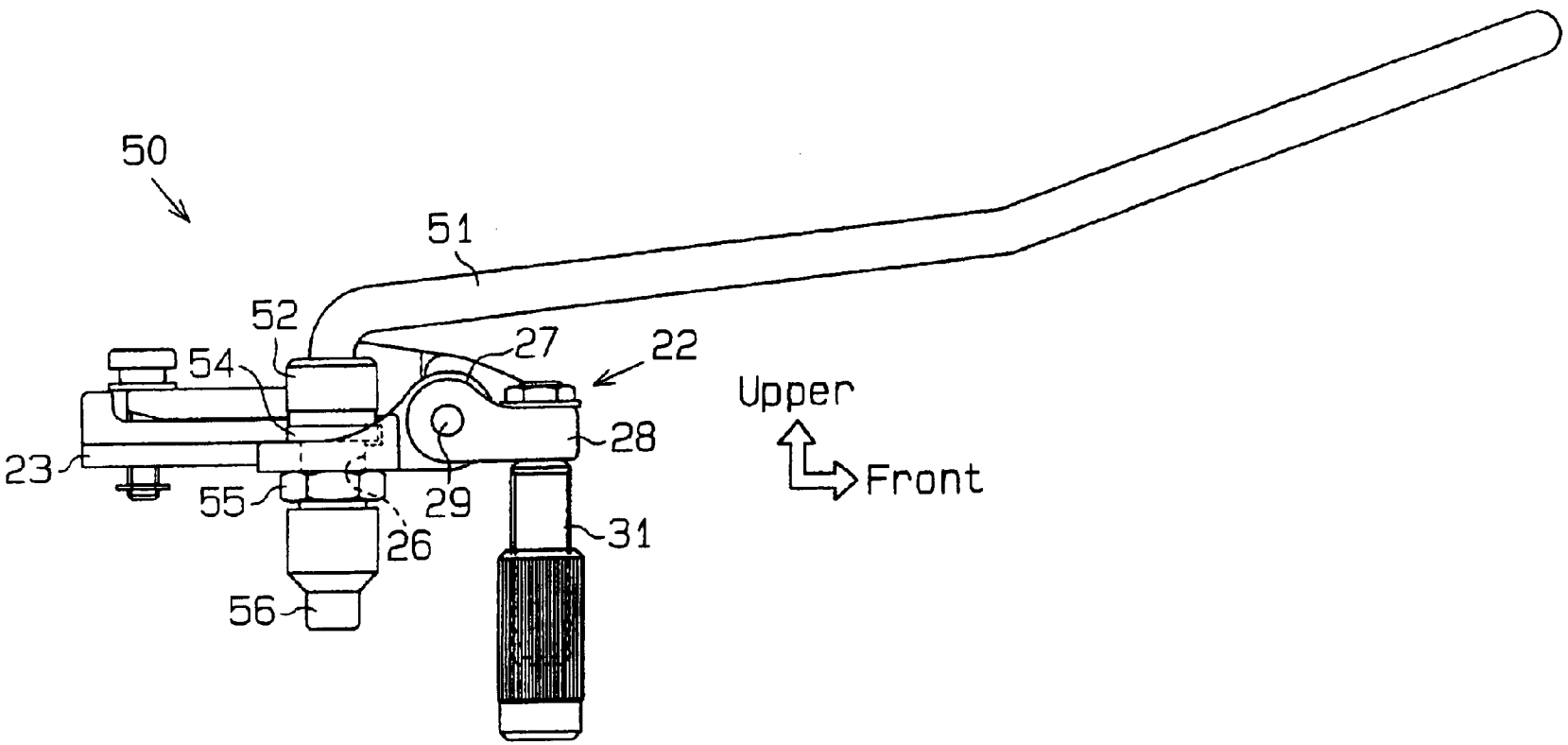
FIG. 6 is a side view of the tremolo operating mechanism.

As shown in FIGS. 2 and 6, the hinge mechanism 22 contains a pair of brackets 28 fixed to the body 12 with a pair of stud bolts 31, respectively, and bearings 30 connected to the brackets 28 through shafts 29 attached to the distal end portions of the brackets 28, respectively. The bearings 30 are fitted into receiving holes 27*a* defined respectively in a pair of bearings 27 formed on each side of the base plate 23 integrally therewith. In this embodiment, the base plate 23 supported swingably by this hinge mechanism 22 corresponds to the swinging member of the present invention.

Figure 3:
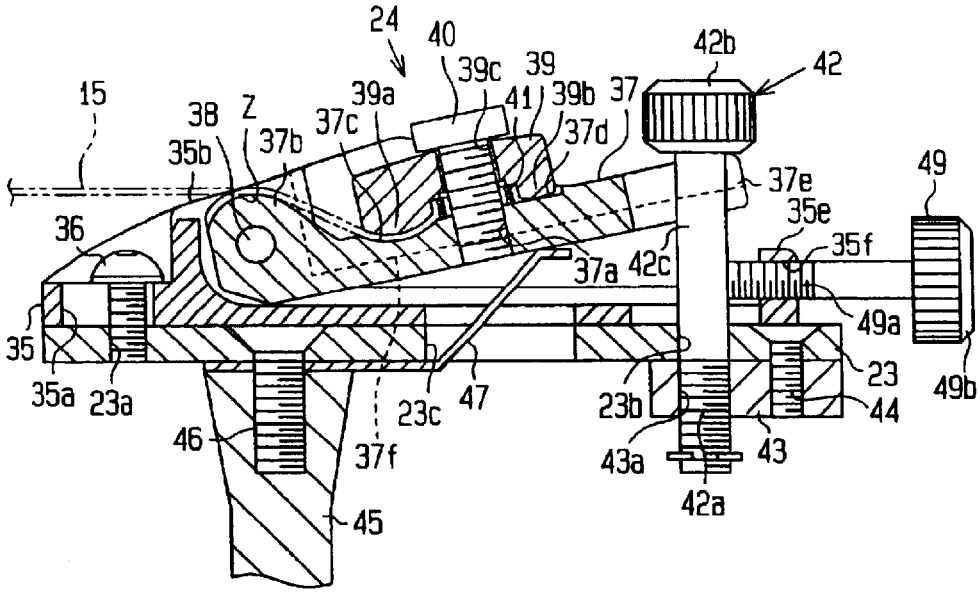
FIG. 3 is a partial cross-sectional view of the tremolo unit.

As shown in FIG. 3, a plurality of saddle holding members 35, which are components of the bridge saddle 24, each have a slot 35*a* at the distal end. Fixing bolts 36 inserted downward through the slots 35*a* are screwed into screw holes 23*a* defined in the base plate 23, respectively, and thus the saddle holding members 35 are secured onto the upper surface of the base plate 23. Each saddle holding member 35 has a pair of bearings 35*b* formed integrally therewith. The distal end portion of a saddle 37 is pivotally connected through a pin 38 to the bearings 35*b*. Each saddle 37 supports a clamp pad 39 on the upper surface, and the clamp pad 39 is fastened against the saddle 37 with a string fixing bolt 40. In this embodiment, the clamp pad 39 and the string fixing bolt 40 form the string holding means. Each saddle 37 contains a screw hole 37*a*, with which the string fixing bolt 40 penetrating the clamp pad 39 is engaged. Each saddle 37 has at the front end portion a string bearing portion 37*b* forming a second critical contact point Z.

Each clamp pad 39 contains a holding portion 39*a*, which holds one of the strings 15 in cooperation with a clamping face 37*c* of the saddle 37, and a supporting point 39*b* abutted against a supporting face 37*d* of the saddle 37. The clamp pad 39 contains a through hole 39*c* through which the string fixing bolt 40 is inserted. The through hole 39*c* is defined between the holding portion 39*a* and the supporting point 39*b*. A tail end of each string 15 is clamped between the holding portion 39*a* of the clamp pad 39 and the clamping face 37*c* of the saddle 37. A spring 41 is interposed as a resilient body between the clamp pad 39 and the saddle 37. The spring 41 is a helical compression spring wrapped around the string fixing bolt 40.

A slot 37*e* is defined in each saddle 37 at the rear end portion. A threaded portion 42*a* of a fine tuning bolt 42 is inserted downward through the slot 37*e*, and a head 42*b* provided at the upper end portion of the threaded portion 42*a* is engaged with the upper edge of the saddle at around the slot 37*e*. As shown in FIG. 3, a fitting plate 43 is attached to the rear end lower surface of the base plate 23 with screws 44. The fitting plate 43 contains a screw hole 43*a*, which is engaged with the threaded portion 42*a* of the fine tuning bolt 42. The base plate 23 contains a guide hole 23*b* for guiding the peripheral surface of a rod portion 42*c* of the fine tuning bolt 42. The base plate 23 also contains a through hole 23*c* for guiding a leaf spring 47 upward through it from under the base plate 23.

Figure 4:
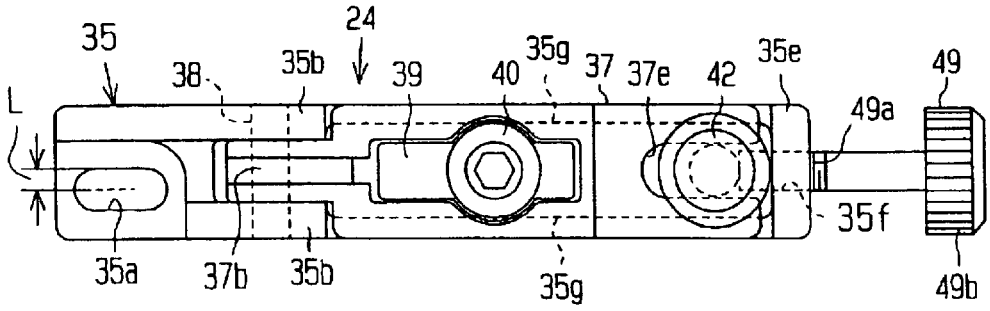
FIG. 4 is a plan view of a bridge saddle.

As shown in FIG. 4, the slot 35*a* of each saddle holding member 35 is offset by a predetermined distance L sideways from the center of the width of the saddle holding member 35. Incidentally, a pair of ridges 35*g* are formed integrally with each saddle holding member 35 on each side of the upper surface such that they are located between the front bearing 35*b* and a rear bearing 35*e* of the saddle holding member 35. Steps 37*f* are formed on each side of the lower side of each saddle 37. The saddle 37 is supported at the steps 37*f* by the ridges 35*g* of the saddle holding member 35. Each saddle holding member 35 contains at the rear end portion thereof the bearing 35*e* having a screw hole 35*f*, and a harmonic tuning bolt 49 is engaged with the screw hole 35*f*. The distal end of a threaded portion 49*a* of the harmonic tuning bolt 49 is abutted against the peripheral surface of the rod portion 42*c* of the fine tuning bolt 42. An operating portion 49*b* of the harmonic tuning bolt 49 is located higher than the upper surface of the body 12. Thus, with the string 15 being maintained in the tuned state, the saddle holding member 35, the saddle 37, and associated members can be moved back and forth by turning the operating portion 49*b*.

Next, the urging force applying mechanism 25 will be described. As shown in FIG. 2, a tremolo block 45 is secured with a plurality of bolts 46 onto the lower surface of the base plate 23. The leaf spring 47 having a comb-like shape is fastened between the lower surface of the base plate 23 and the upper surface of the tremolo block 45, and each tooth of the comb-like leaf spring 47 penetrates the associated through hole 23*c* of the base plate 23 and are brought into press contact with the lower surface of the associated saddle 37, as shown in FIG. 3. Thus, the saddle 37 is pressed against the head 42*b* of the fine tuning bolt 42 at around the slot 37*e* to prevent generation of vibration noises and to improve followability of the saddle 37 to the fine tuning bolt 42. A pair of springs 48 are each fixed at one tail end to the lower surface of the tremolo block 45, as shown in FIG. 2. The other tail end of each spring 48 is engaged with a bracket 19.

The bracket 19 is secured to the body 12 with a pair of screws 20. The springs 48 urge the tremolo block 45 to turn clockwise as viewed in FIG. 2. Thus, the base plate 23 is urged to pivot clockwise on the shafts 29. Consequently, the tensions of the respective strings 15 fitted to the bridge saddle 24 are balanced with the urging force of the urging force applying mechanism 25, and thus the base plate 23 is maintained substantially parallel to the body.

Next, the tremolo operating mechanism 50 will be described in detail.

Figure 5:
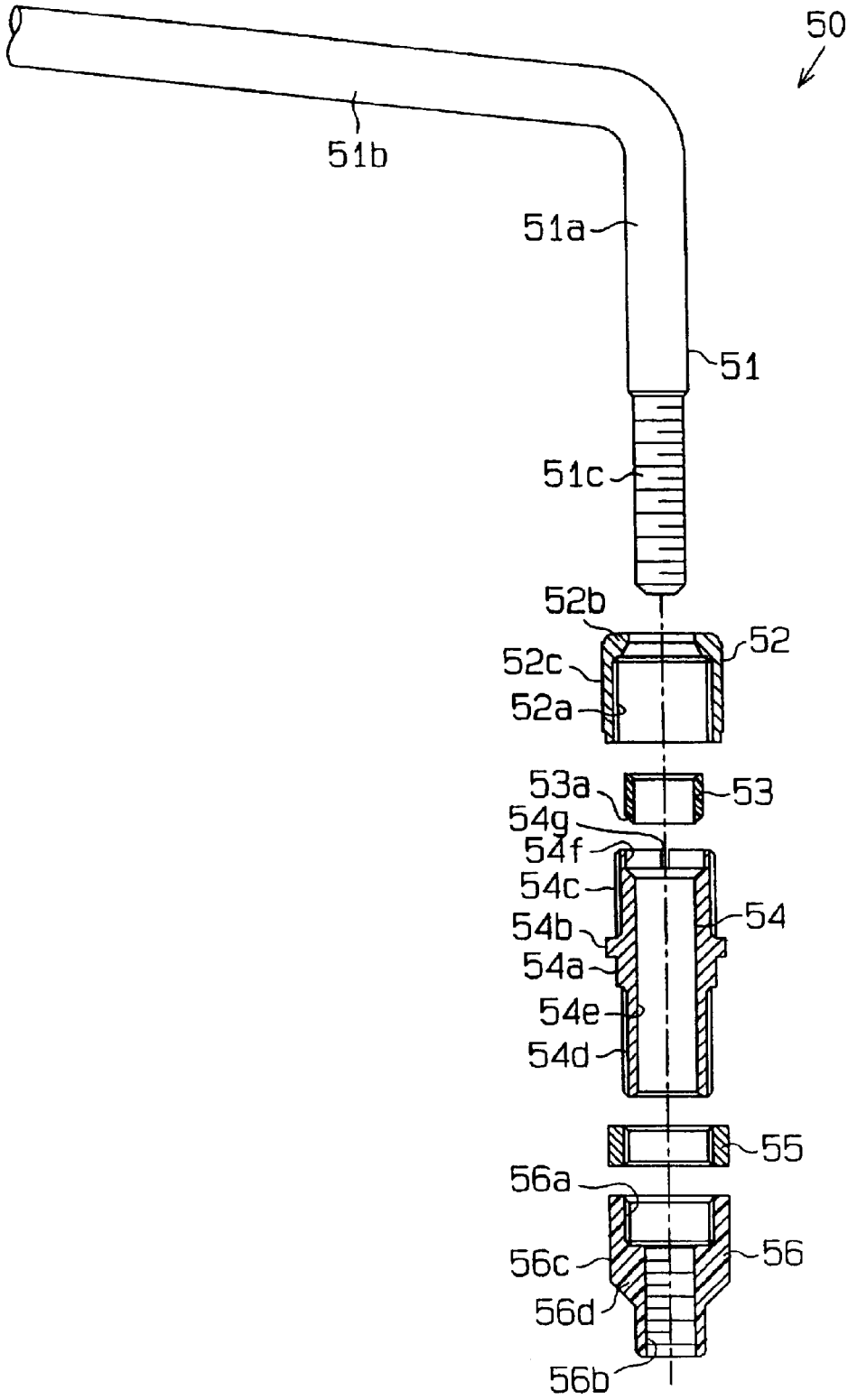
FIG. 5 is an exploded cross-sectional view of a tremolo operating mechanism.

As shown in FIGS. 2 and 5, the tremolo operating mechanism 50 consists essentially of a tremolo arm 51, a torque adjusting screw 52, a resin bushing 53, an arm socket 54, an arm socket nut 55, and an arm receiving resin nut 56.

The arm socket 54 as a whole is a substantially cylindrical resin member or a metallic member. The arm socket 54 has at around the middle thereof a cylindrical face 54*a* formed concentrically therewith, and a flange 54*b* is formed at the upper end of the cylindrical face 54*a* to protrude radially outward. The arm socket 54 corresponds to the holding cylinder of the present invention. The cylindrical face 54*a* has a pair of parallel planar portions 54*h* formed to oppose each other along an external thread 51*c* of the tremolo arm 51, so that the relevant portion of the arm socket 54 conforms to the track field-like profile of an arm socket fixing hole 26 defined in the base plate 23. As shown in FIGS. 2 and 6, the arm socket fixing hole 26 is defined in the right bearing 27 of the base plate 23 at the rear part. When the arm socket nut 55 is fastened to the arm socket 54, the planar portion 54*h* of the arm socket 54 engages with the internal surface of the fixing hole 26 to restrict rotation of the arm socket 54.

An upper external thread 54*c* is formed on an upper peripheral surface of the arm socket 54 that is above the flange 54*b*. A lower external thread 54*d* is also formed on a peripheral surface of the arm socket 54 below the cylindrical face 54*a*. The arm socket 54 contains a through hole 54*e* having a circular cross-section with an inside diameter greater than the outside diameter of a shaft 51*a* of the tremolo arm 51. The arm socket 54 has at the top of the through hole 54*e* a resin bushing holding portion 54*f* having a circular cross-section with an inside diameter greater than that of the through hole 54*e* so that the resin bushing holding portion 54*f* communicates with the through hole 54*e*. The internal surface of the resin bushing holding portion 54*f* is tapered such that the inside diameter reduces gradually downward to be equal at the lower end thereof to that of the through hole 54*e*. Further, the resin bushing holding portion 54*f* contains a notch 54*g*. The notch 54*g* extends from the upper end of the resin bushing holding portion 54*f* to the vicinity of the lower end thereof. The width of the notch 54*g* is designed to be the same as the width of a whirl-stop 53*b* of the resin bushing 53 (see FIG. 8(*a*)). The notch 54*g* engages with the whirl-stop 53*b* to restrict rotation of the resin bushing 53.

The arm socket 54 is inserted downward into the arm socket fixing hole 26 of the base plate 23, as shown in FIGS. 2, 6, 7(*a*) and 7(*b*). In the state where the lower face of the flange 54*b* of the arm socket 54 is abutted against the upper surface of the base plate 23, the arm socket nut 55, which is a thin hexagonal nut, is engaged with the lower external thread 54*d*. Thus, the arm socket 54 is secured to the base plate 23 with the upper surface of the nut 55 being abutted against the lower surface of the base plate 23.

Both the base plate 23 and the arm socket nut 55 are made of a metal such as stainless steel. Meanwhile, the arm socket 54 is made of a high-strength material such as engineering plastics including polyamide, polyacetal and polyethylene terephthalate. Alternatively, the arm socket 54 may be made of a metal such as stainless steel. Therefore, the arm socket 54 is very strong and swings integrally with the base plate 23. It should be noted here that an arm socket 54 made of a resin has elasticity and improves operability of the tremolo arm 51.

FIG. 8(*a*) is a perspective view of the resin bushing 53 of the present embodiment. The resin bushing 53 corresponds to the second supporting member made of an elastic body or the annular member. The resin bushing 53 has a substantially cylindrical shape having an upper open end and a lower open end. While the resin bushing 53 has the same inside diameter throughout its length, the outside diameter at the lower end portion thereof is designed to reduce gradually downward to form a tapered portion 53*a* having a gradient of, for example, about 45° with respect to its axis.

The bushing 53 has the whirl-stop 53*b* formed at the upper end portion to protrude radially outward. The whirl-stop 53*b* is engaged with the notch 54*g* of the resin bushing holding portion 54*f* to restrict rotation of the resin bushing 53. A slit 53*c* is formed in the bushing 53 on the opposite side across from the whirl-stop 53*b*. The slit 53*c* causes the bushing 53 to flex inward when it is pressed from the periphery to reduce the inside diameter of the bushing 53. As the material of the bushing 53, a polyamide resin such as Nylon 6 (registered trade name) is employed in the present embodiment because of its excellent resilience, excellent smoothness and excellent abrasion resistance. It is of course possible to use various kinds of other elastic bodies in view of operability, durability, cost, etc. The elastic bodies referred to herein do not include those, which generate impacts and noise when they interfere with other parts and are abutted against one another, such as metallic parts, but include those which have a degree of elasticity to absorb impacts. Therefore, the elastic bodies are not limited to soft materials such as rubber and sponge, but relatively hard resins can also be used.

The lower part of the resin bushing 53 is fitted in the resin bushing holding portion 54*f* of the arm socket 54. Here, the external profile of the resin bushing 53 including the tapered portion 53*a* and the internal profile of the resin bushing holding portion 54*f* are designed to substantially match each other.

The torque adjusting screw 52 has a substantially cylindrical shape having an open upper end and an open lower end, as shown in FIG. 5. The screw 52 has on the internal surface an internal thread 52*a* to be engaged with the upper external thread 54*c* of the arm socket 54. Further, the inside diameter of the screw 52 is reduced at the upper end portion to be smaller than the outside diameter of the upper portion of the resin bushing 53 and to be greater than the outside diameter of the shaft 51*a* of the tremolo arm 51, forming a pressing portion 52*b*. The screw 52 has on its outer peripheral surface 52*c* anti-slip flutes.

As shown in FIG. 5, the arm receiving resin nut 56 has at the upper end portion an arm socket engaging portion 56*a*. The arm socket engaging portion 56*a* has on the internal surface an internal thread which is engageable with the lower external thread 54*d* of the arm socket 54. This arm receiving resin nut 56 corresponds to the first supporting member of the present invention. The nut 56 has on the lower part a tremolo arm engaging portion 56*b*. The tremolo arm engaging portion 56*b* has on the lower internal surface an internal thread which is engageable with the external thread 51*c* of the tremolo arm 51. Since the arm receiving resin nut 56 is made of resin, the tremolo arm engaging portion 56*b* can be engaged nicely with the external thread 51*c* with no backlash. This dispenses with backlash of the tremolo arm 51 during tremolo operation and can apply a torque to the base plate 23 when the tremolo arm 51 is rotated.

The outer peripheral surface 56*c* of the nut 56 is composed essentially of two cylindrical surfaces having different outside diameters corresponding to the inside diameter of the arm socket engaging portion 56*a* and to the inside diameter of the tremolo arm engaging portion 56*b*, respectively. However, the outside diameter at the upper part of the tremolo arm engaging portion 56*b* is designed to be as thick as the outside diameter of the arm socket engaging portion 56*a* to form a thick wall portion 56*d* so that it can withstand the stress from the tremolo arm 51.

Procedures for assembling the tremolo operating mechanism 50 and operation of the mechanism 50 will be described below with reference to FIGS. 5, 7(*a*) and 7(*b*).

After the arm socket 54 is secured to the base plate 23 with the arm socket nut 55 as described above, the resin bushing 53 is fitted in the resin bushing holding portion 54*f* of the arm socket 54. Here, the tapered portion 53*a* of the resin bushing 53 is oriented to face downward, and the whirl-stop 53*b* is inserted downward to the notch 54*g*. Next, the torque adjusting screw 52 is engaged slightly with the upper external thread 54*c* of the arm socket 54. Meanwhile, the arm socket engaging portion 56*a* of the arm receiving resin nut 56 is engaged with the lower external thread 54*d* of the arm socket 54 and is fastened to it.

Then, the shaft 51*a* of the tremolo arm 51 is inserted into the resin bushing 53 through the upper opening of the torque adjusting screw 52. When the external thread 51*c* of the tremolo arm 51 is abutted against the upper edge of the tremolo arm engaging portion 56*b*, the tremolo arm 51 is rotated clockwise on the shaft 51*a* in terms of a top view. Thus, the tremolo arm 51 engages with the engaging portion 56*b* to sink as it is rotated. When the tremolo arm 51 is at a desired height, the torque adjusting screw 52 is fastened to the tremolo arm 51. As the torque adjusting screw 52 is fastened to it, its pressing portion 52*b* of the torque adjusting screw 52 is abutted against the resin bushing 53 to press it gradually. Meanwhile, the tapered portion 53*a* of the resin bushing 53 is pressed against the bevel at the lower end portion of the resin bushing holding portion 54*f*. Thus, the tapered portion 53*a* flexes inward along the bevel to be pressed against the shaft 51*a* of the tremolo arm 51 and increases friction between the resin bushing 53 and the shaft 51*a*. This increases the torque necessary for rotating the tremolo arm 51.

Provided that a player holds the electric guitar 11 with the right side of the guitar facing downward and that the player pulls up a handle 51*b* of the tremolo arm 51 to the active position where the handle 51*b* opposes the strings 15 during playing of the guitar, the handle 51*b* turns downward spontaneously due to its own weight if the player releases the handle 51*b* in the case where the torque necessary for rotating the tremolo arm 51 is small. Thus, the handle 51*b* is located at the retracted position where it does not oppose the strings 15. Meanwhile, if the torque is set at a high level, the handle 51*b* can be allowed to stay at the active position resisting against the weight of the tremolo arm 51.

When the tremolo arm 51 is operated for producing a tremolo effect, the handle 51*b* of the tremolo arm 51 is rotated to the active position, and the player shifts the handle 51*b* away from or toward the body 12 after plucking the strings 15. Thus, the tension of each string can be increased or reduced.

Next, effects of the tremolo unit 21 having the arrangement as described above will be listed together with its components.

(1) In the tremolo unit 21 of the above embodiment, the tremolo arm 51 is supported by the arm receiving resin nut 56 corresponding to the first supporting member and the resin bushing 53 corresponding to the second supporting member, so that the tremolo arm 51 is not brought into contact with the arm socket 54 corresponding to the holding cylinder. Thus, there occur neither impacts nor noises which can be caused by contact of the tremolo arm 51 with the arm socket 54 to improve operability of the tremolo arm 51.

(2) In the above embodiment, since the tremolo unit 21 is provided, as the height adjusting means, with the tremolo arm engaging portion 56*b* of the arm receiving resin nut 56 and the external thread 51*c* of the tremolo arm 51, which is engageable with the tremolo arm engaging portion 56*b*, a player can adjust the height of the tremolo arm 51 to a desired level by rotating the tremolo arm 51 on the shaft 51*a*.

(3) In the above embodiment, the tremolo unit 21 is provided, as the constituents of the torque adjusting means, with the arm socket 54, a resin bushing 53 to be fitted in the arm socket 54 and a torque adjusting screw 52, which is engaged with the arm socket 54 to press the resin bushing 53 downward. Therefore, a player can adjust the torque necessary for rotating the tremolo arm 51 to a desired value merely by turning the torque adjusting screw 52.

(4) In the above embodiment, since the resin bushing 53 and the arm receiving resin nut 56 are made of a polyamide resin, they can support the tremolo arm 51 and the arm socket 54 while serving as shock absorbers between them. In addition, the resin bushing 53 and the arm receiving resin nut 56 perform appropriate elastic deformation to enable smooth operation of the tremolo arm 51 by applying a sufficient torque in the rotation of the tremolo arm 51.

It should be apparent to those skilled in the art that the present invention may be embodied in many other specific forms without departing from the spirit or scope of the invention. Particularly, it should be understood that the invention may be embodied in the following forms.

In this embodiment, while a polyamide resin such as Nylon 6 (registered trade name) is used for the resin bushing shown in FIG. 8(*a*), various other materials such as hard rubbers and polypropylene may be used.

Further, if the bushing 53 is allowed to have a simple cylindrical shape like a resin bushing 153 as shown in FIG. 8(*b*), the bushing 53 can be manufactured at a lower cost. Otherwise, a slit may be formed in the resin bushing 253 shown in FIG. 8(*d*) to make it more flexible. The bushing may be split into two parts like the resin bushing shown in FIG. 8(*d*). The bushing 353 shown in FIG. 8(*d*) corresponds to the split annular member.

In the present embodiment, while the base plate 23 is exemplified as the swinging member, it is also possible to form a columnar swinging member, to extend a lever forward from the swinging member and to mount the tremolo operating mechanism on the lever. This columnar swinging member is swingably supported by shafts disposed on each side thereof. In this case, a helical compression spring may be interposed between the lever and the body 12 to serve as an urging force applying mechanism in place of the urging force applying mechanism 25. The string holding means is provided on the columnar swinging member and is brought into the second critical contact by a saddle disposed directly on the body 12. As the string holding means, there may be used an arrangement in which strings 15 are inserted through holes defined in the columnar swinging member to hold them by the ball-end attached to each string 15.

Therefore, the present examples and embodiments are to be considered as illustrative and not restrictive and the invention is not to be limited to the details given herein, but may be modified within the scope and equivalence of the appended claims.

What is claimed is:

1. A tremolo unit for use in an electric guitar having a body, a head, and a plurality of strings, wherein the strings are attached at the distal ends to the head of the electric guitar and at the proximal ends to the tremolo unit, the tremolo unit comprising:

a swinging member supported swingably on an upper surface of the body;

a string holding device provided on the swinging member to hold each string at the proximal end thereof;

an urging force applying device for applying an urging force to the swinging member, the urging force countervailing the tension of the strings;

a tremolo arm having a shaft rotatably fitted to the swinging member and a handle extended from the shaft at an angle, wherein the handle of the tremolo arm is capable of shifting between an active position, where the handle opposes the strings, and a retracted position, where the handle is spaced away from the strings, and wherein the swinging member is designed to be swung through the handle to change tension of each string, a holding cylinder provided on the swinging member to insert the shaft of the tremolo arm therein;

a first supporting member made of an elastic body, the first supporting member being interposed between the holding cylinder and the shaft so as to avoid contact between them; and a second supporting member made of an elastic body, the second supporting member being interposed between the holding cylinder and the shaft at a position spaced away from the first supporting member so as to avoid contact between them.

2. The tremolo unit according to claim 1, wherein the shaft of the tremolo arm is screwed into the first supporting member, and the height of the handle from the body is adjusted depending on the amount of rotation of the shaft.

3. The tremolo unit according to claim 1, wherein the second supporting member functions as torque adjusting means for adjusting a torque necessary for rotation of the tremolo arm.

4. The tremolo unit according to claim 3, wherein the second supporting member is an annular member, and the tremolo unit further comprises a torque adjusting screw, which is engaged with the holding cylinder and rotates to shift along the axis of the holding cylinder, and wherein the torque required for rotation of the tremolo arm is adjusted by changing via rotation of the adjusting screw the force for inserting the annular member into a clearance between the shaft and the holding cylinder.

5. The tremolo unit according to claim 4, wherein the annular member is split or has a slit.

6. The tremolo unit according to claim 1, wherein the at least one of the first supporting member and the second supporting member is made of resin or rubber.

7. The tremolo unit according to claim 1, wherein the holding cylinder is made of an elastic body.

8. An electric guitar comprising:

a body, a head, a plurality of strings, and a tremolo unit, with the distal end of each string fitted to the head of the electric guitar, and the proximal end of each string fitted to the tremolo unit, and the tremolo unit including:

a swinging member supported swingably on an upper surface of the body;

a string holding device provided on the swinging member to hold each string at the proximal end;

an urging force applying device for applying an urging force to the swinging member, the urging force countervailing the tension of the strings;

a tremolo arm having a shaft rotatably fitted to the swinging member and a handle extended from the shaft at an angle, wherein the handle of the tremolo arm is capable of shifting between an active position, where the handle opposes the strings, and a retracted position, where the handle is spaced away from the strings, and wherein the swinging member is designed to be swung through the handle to change tension of each string, a holding cylinder provided on the swinging member to insert the shaft of the tremolo arm thereto;

a first supporting member made of an elastic body, the first supporting member being interposed between the holding cylinder and the shaft so as to avoid contact between them; and a second supporting member made of an elastic body, the second supporting member being interposed between the holding cylinder and the shaft at a position spaced away from the first supporting member so as to avoid contact between them.

9. The electric guitar according to claim 8, wherein the shaft of the tremolo arm is screwed into the first supporting member, and the height of the handle from the body is adjusted depending on the amount of rotation of the shaft.

10. The electric guitar according to claim 8, wherein the second supporting member functions as torque adjusting means for adjusting a torque necessary for rotation of the tremolo arm.

11. The electric guitar according to claim 10, wherein the second supporting member is an annular member, and the tremolo unit comprises a torque adjusting screw, which is engaged with the holding cylinder and rotates to shift along the axis of the holding cylinder, and wherein the torque required for rotation of the tremolo arm is adjusted by changing via rotation of the adjusting screw the force for inserting the annular member into a clearance between the shaft and the holding cylinder.

12. The electric guitar according to claim 11, wherein the annular member is split or has a slit.

13. The electric guitar according to claim 8, wherein the at least one of the first supporting member and the second supporting member is made of resin or rubber.

14. The electric guitar according to claim 8, wherein the holding cylinder is made of an elastic body.

* * * * *